US005743445A

United States Patent [19]

Benarrouch

[11] Patent Number: 5,743,445

[45] Date of Patent: Apr. 28, 1998

[54] OPENING AND POURING DEVICE INCLUDING VOLUME POURING SPOUT FOR A CONTAINER FOR A LIQUID AND METAL COVER CONTAINING SAME

[76] Inventor: Jacques Benarrouch, 23, rue Clement Michut, 69100 Villeurbanne, France

[21] Appl. No.: 643,483

[22] Filed: May 6, 1996

[30] Foreign Application Priority Data

Jun. 6, 1995 [FR] France ..... 95 06880

[51] Int. Cl.[6] ..... B65D 47/10

[52] U.S. Cl. ..... 222/541.9; 220/269; 222/530; 222/526; 222/567

[58] Field of Search ..... 222/143, 541.9, 222/566, 567, 569, 570, 526, 530, 533, 534; 220/265, 266, 268, 269, 716, 717

[56] References Cited

U.S. PATENT DOCUMENTS

| | | | |
|---|---|---|---|
| 3,197,089 | 7/1965 | Michael | 220/717 X |
| 3,473,705 | 10/1969 | May et al. | 222/541.9 |
| 3,915,360 | 10/1975 | Leger et al. | 222/531.9 X |
| 3,980,214 | 9/1976 | Dahlquist | 222/531 X |
| 4,000,838 | 1/1977 | Bogert | 222/529 |
| 4,073,403 | 2/1978 | Orange | 220/269 |
| 4,216,880 | 8/1980 | Drelichowski | 222/541.9 X |
| 4,407,425 | 10/1983 | Combs | 220/717 X |
| 4,561,557 | 12/1985 | Park et al. | 222/531 X |
| 4,673,099 | 6/1987 | Wells | 220/269 |
| 5,000,337 | 3/1991 | Im | 222/531 X |
| 5,415,313 | 5/1995 | Sang-Seo | 222/541.9 X |
| 5,647,499 | 7/1997 | Piazza | 220/269 |

FOREIGN PATENT DOCUMENTS

| | | | |
|---|---|---|---|
| 2233239 | 1/1975 | France . | |
| 2721860 | 11/1978 | Germany | 222/541.9 |
| 649511 | 5/1985 | Switzerland | 220/269 |
| WO86/01488 | 3/1986 | WIPO . | |
| WO95/12526 | 5/1995 | WIPO . | |

*Primary Examiner*—Kevin P. Shaver
*Attorney, Agent, or Firm*—Michael J. Striker

[57] ABSTRACT

The opening and pouring device is useful for a cylindrical liquid-containing container, particularly a metal beverage can, having a cover (A) provided with an openable protective cap (6) defined by a precut perimeter (7) in the cover (A). The opening and pouring device is a metal hand lever riveted to the cover (A) and acting as an opening device for staving in the protective cap (6). The metal hand lever includes a volume pouring spout (1) acting as a drive arm thereof for staving in the protective cap (6) and includes a lip (L) and an open clipping ring (12) provided with a clipping flange (13) of semicircular cross-section consisting of an outer lateral thickened portion for securing the pouring spout (1) in the hole formed by staving in the protective cap. The metal hand lever also includes a riveting tongue (3) provided with a riveting hole (5) and a hammer (2) acting as resistant arm and provided with a reinforced nose (10) for staving in the protective cap (6) as well as a strip (11) of spreadable excess metal between the riveting hole (5) and a side of the hammer (2) opposite the staving nose (10). Once the protective cap (6) is staved in, the base of the pouring spout is centered and is clipped in the hole left vacant by the protective cap after 180° rotation of the hand lever on a sliding axis radial to the cover (A).

10 Claims, 4 Drawing Sheets

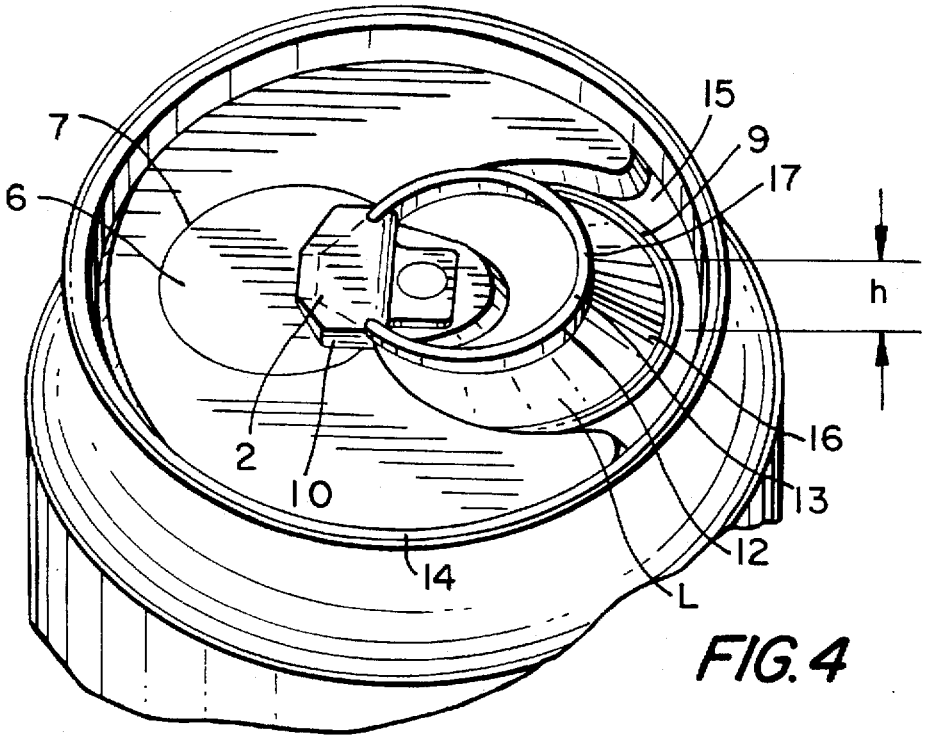
FIG. 4
FIG. 5
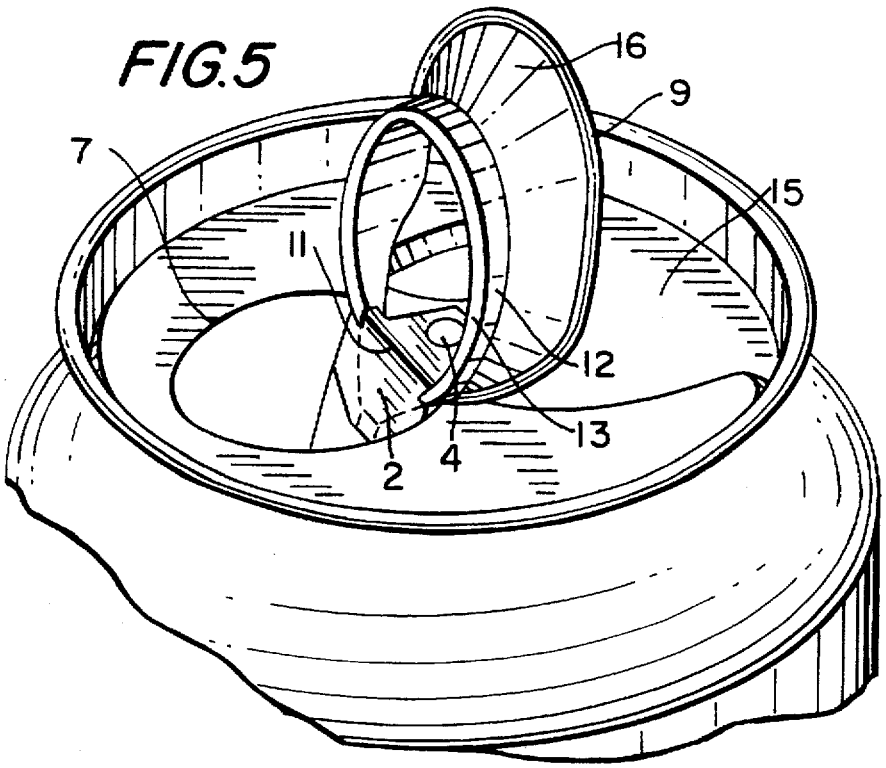

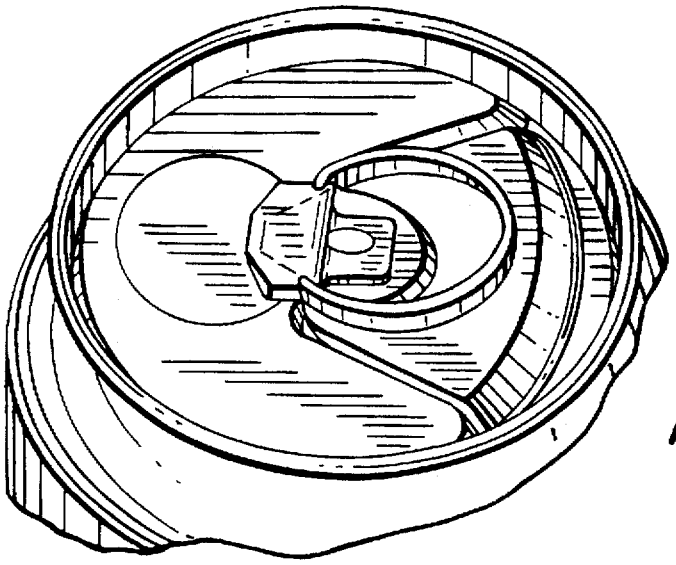
FIG.9
FIG.10
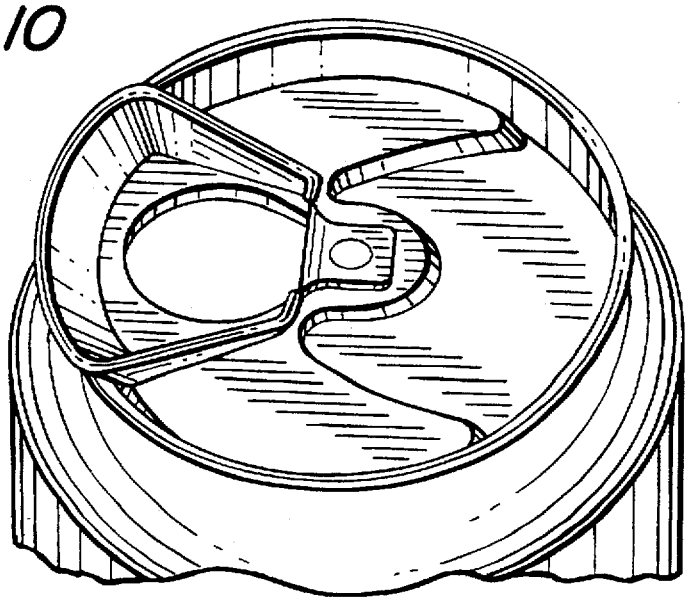

OPENING AND POURING DEVICE INCLUDING VOLUME POURING SPOUT FOR A CONTAINER FOR A LIQUID AND METAL COVER CONTAINING SAME

BACKGROUND OF THE INVENTION

The present invention concerns a volume pouring spout for a metal container for a liquid, especially a beverage can, and a metal cover including the volume pouring spout, and more particularly, concerns a volume pouring spout which acts as a drive arm of a riveted metal hand lever for staving in the precut protective cap of a metal container holding a liquid and which is mounted inverted in a recessed portion of the metal container cover.

There are numerous metal containers on the market that have a metal cover fastened to them, welded or crimped on the container, intended to hold potable (or impotable) liquids usable by pouring.

For some years those aluminum or steel containers have been the object of numerous technological developments, the principal ones being embodied particularly in the fabrication of carbonated (or noncarbonated) beverage containers, more commonly called cans, manufactured in quantities of several hundred million per day over the entire world. Those cans are cylindrical, especially because of the fact that tight fastening of the covers can be more reliably accomplished on circular sections.

The present invention is based on metal cans (or beverage containers), which have technically highly perfected covers.

In general, concave-bottom cans of this kind are intended to be stacked vertically. The body of the can is made separately from the cover, which is crimped in a high-speed automated process after being filled directly at the beverage packagers, called fillers or canners.

In fact, the most advanced technology is directed at making covers to be crimped. The latter, seen from above, possess a cylindrical raised rim, the inner base of which has a circular channel. A cylindrical hollow pseudo-rivet formed by a central punching of the inner face of the cover protrudes from the center of the cover and, therefore, is closed tightly at its end.

A small flat metal lever, a so-called tab, elongated in shape and having a hole in the center, the diameter of which slightly exceeds the diameter of the above-mentioned pseudo-rivet, is slipped via the hole around the cylindrical body of the pseudo-rivet, in order to be positioned flat against the cover before the riveting by vertical flattening of the pseudo-rivet to fix the lever to the cover.

The cover contains a protective cap most often generally rounded in shape, formed from a perimetric line of tearing along which the metal of the cover is precut.

The tab, of complex fabrication, generally has a nose often trapezoidal in shape, the edge of which is seamed for good bending resistance on use of the lever for tearing out the protective cap. In general, according to the tab fabrication process, grooves are arranged at the edge of the tab blank, at the end of the seamed nose, in order to relax the compressive stresses having appeared on seaming of the edge.

The real concerns of can manufacturers (canmakers) have totally neglected the safety and convenience of consumers. These concerns relate to manufacturing can bodies and covers lighter and lighter and faster and faster to make in order to limit costs of metal, manufacture and transportation.

The present covers of cans are provided with a riveted flat staving lever for the sole avowed purpose of being able to stack as many covers in a given space as possible, and that determination for maximum stacking limits the current tab to its function as hammer of a protective cap, the perimeter of which is precut on the cover. This results in an inadequate cutting hole and sloppy cover when drinking directly from the can, which is the case with the largest number of consumers, no matter what the beverage.

Some developments described in the following patents are also part of technological background of the present invention: FR-A-2,233,239 (CONTINENTAL CAN COMPANY), U.S. Pat. No. 3,980,214 (DAHLQUIST), WO-A-86.01488 (SCAVO), U.S. Pat. No. 4,073,403 (ORANGE), U.S. Pat. No. 4,000,838 (BOGERT), U.S. Pat. No. 5,000,337 (IM), U.S. Pat. No. 4,561,557 (PARK), and U.S. Pat. No. 3,473,705 (MAY). In most of those patents the inventors have sought by different means to introduce a pouring spout on the cover of a cylindrical metal container holding a liquid. Those pouring spouts, usually dipping into the can on assembly, are set in place at the time of opening after tearing of the cover outward by pulling of a ring. None of those patents has been exploited for beverage cans.

International Patent No. 93/01907 (THOMASSEN & DRIJVER-VERBLIFA) of November 1993, continued by PCT No. NL, 94/00265 and published on May 11, 1995, also forms part of the technological background of the invention.

This patent describes a three-piece metal container cover provided with a tiltable tongue. This tongue, called pouring tongue in that patent, is designed for very thick liquids (e.g., condensed milk) or for powders. It involves actually a flat component invertible after perforation of the protective cap and contains very low edges on its sides. The inventor, as stated in his specification, keeps as close as possible to the concept of a standard flat lever (SOT) riveted on a cover, which retains its flat shape, for the sole purpose of being able to include its tongue in the present production batches.

The device of that invention is in no case suitable for common beverages which are excluded by the disclosure of the patent (the specification of the THOMASSEN & DRIJVER-VERBLIFA patent clearly states at the very beginning that the tiltable tongue is intended "for liquids such as condensed milk and possibly powders"). The inventor proposes a restricted range of applications, but on condition that the user is skilful in pouring or measuring them out. Hence, the technical requirement of very low edges on both sides of the tongue contributes to spillage of the contents beyond those edges, which are ineffective barriers, particularly in case of an accelerated flow for any reason whatever.

SUMMARY OF THE INVENTION

It is an object of the present invention to provide an opening a pouring device including an improved volume pouring spout for a cover for a metal container for common liquids as well a thicker liquids and powders.

It is also an object of the present invention to provide a cover for a metal container for common liquids as well thicker liquids and powders having a metal lever or tab for opening the container which also forms a volume pouring spout when the container is opened.

The present invention is based on a beverage container cover, first, that has a perimetrically tearable protective cap, symmetrically positioned in relation to a diametrical line on the cover and that has a hollow central pseudo-rivet closed at its end and obtained by stamping or punching of the inner face of the cover.

The invention is therefore intended to offer, in its aspect related to the cover of the can, a volume pouring spout, which acts as drive arm of a metal hand lever, the resistant arm of which is the hammer, which resembles all known tab noses, the lever itself comprising the integrated pouring spout and hammer and being riveted in the proper direction and position on the cover like all known tabs by the pseudo-rivet known in the art, the hammer of the lever serving to stave in the protective cap with precut perimeter, according to also known precutting methods.

The invention is especially intended to provide a pouring spout as an integral part of the lever, because, as can be clearly deduced from the existing methods, while they make it possible to open metal can-type liquid containers by staving in the protective cap of the cover, they do not make it possible to consume the beverage directly from the container without the risk of cutting one's lips by drinking through the hole in the cover drawn out along its perimeter. Also the invention avoids spillage of beverage through the circular channel on both sides of the mouth due to drinking directly through that hole, tight application of the lips around the hole being rendered impossible just by reason of the concavity of that channel.

Furthermore, when drinking the beverage directly from the conventional can, the consumer swallows all the dirt situated around the hole and in the channel sector situated between the hole and the raised rim of the cover. Even when the contents of the can are poured into a glass, the liquid flow carries along dirt into the glass in the same way. The pouring spout according to the invention avoids the foregoing problems.

A fundamental difference between the specific tongue of the THOMASSEN & DRIJVER-VERBLIFA patent and the pouring spout of the invention is that the latter, as described below, is a genuine pouring spout, that is, a high-walled volume pouring spout, making it possible either to pour or to drink directly from the container common liquids (mineral water and other carbonated or noncarbonated beverages), and also to pour thicker liquids, such as oils and condensed milk, as well as powders.

BRIEF DESCRIPTION OF THE DRAWING

The objects, features and advantages of the present invention will now be illustrated in more detail by the following detailed description, reference being made to the accompanying drawing in which:

FIGS. 4 to 6 are perspective action views showing the cover of FIG. 3 with the pouring spout of FIG. 1 attached to it via the pseudo-rivet, wherein FIG. 4 shows the pouring spout inverted and the protective cap closing the cover, FIG. 5 shows the lever including the pouring spout being rotated to open the protective cap and FIG. 6 shows the cover opened with the pouring spout in a position to facilitate the pouring of the contents from the container;

FIGS. 9 and 10 are perspective views showing an additional embodiment of the pouring spout and can cover in operation.

DESCRIPTION OF THE PREFERRED EMBODIMENT

Figure 1:
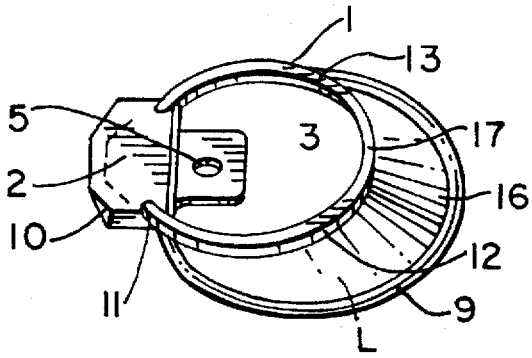
FIG. 1 is a perspective view of a pouring spout for a metal container according to the invention.
Figure 2:
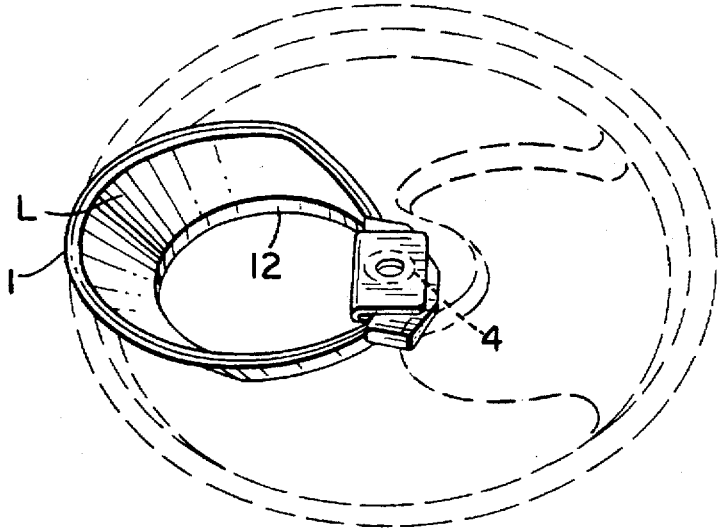
FIG. 2 is a perspective view of another geometric form of the pouring spout in position on the metal container after the metal container has been opened.
Figure 3:
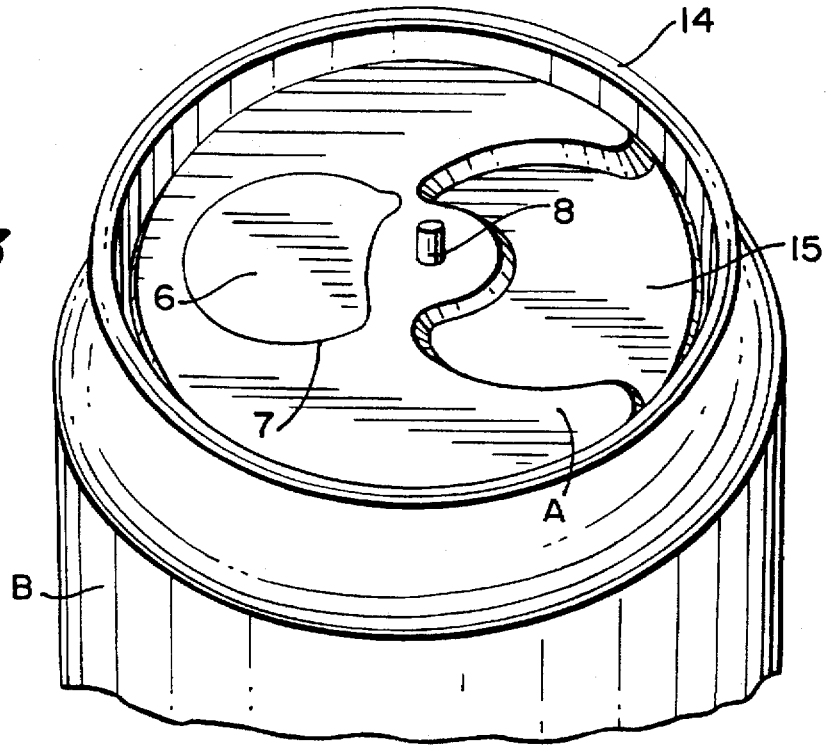
FIG. 3 is a perspective cutaway view of a cover for a metal container suitable for receiving a pouring spout according to the invention.

The invention is shown in FIGS. 1, 2 and 3 showing two forms of the invention, among a large number of possible geometric forms of the pouring spout.

FIG. 1 shows (in perspective, like all of the other figures) the overall concept of the pouring spout 1 in inverted position. The pouring spout 1 is provided with a hole 5 (FIG. 1) in which a hollow pseudo-rivet 8 stamped in the metal cover and visible in FIG. 3 is inserted for crimping. The hole 5 is bored through the riveting lug 3 of the lever. The lever has a hammer 2 with reinforced nose 10 in the active position. The pouring spout 1 has a lip L provided with a lip 9 and seen from below in FIG. 1, since the pouring spout is inverted in that Figure. The pouring spout 1 also has a lower open clipping ring 12 intended, after a 180° radial rotation of the pouring spout from the cover A, to be lodged in the hole closed by protective cap 6 of the cover in FIG. 3. The open clipping ring 12 has a clipping flange 13 of semicircular cross-section provided by an outer lateral thickened portion of the open clipping ring 12. The clipping flange 13 constitutes the perimetric means for clipping the pouring spout 1 by manual pressure of the ring 12 in the hole 6 along the precut tearing line 7 of the protective cap on FIG. 3, after bevel centering of the leading edge of the flange 13 on the periphery of the hole of the protective cap 6. The riveting lug 3 is provided with an integrated tolerance strip 11 (excess metal) located between the passive edge of the hammer 2 (side opposite the staving nose) and the riveting hole 5 of that lug.

FIG. 2 represents the pouring spout 1 in its operating position to assist in pouring out the contents of the container B. In that position the ring 12 is clipped in the hole of the protective cap 6 on FIG. 3. The pseudo-rivet 8 of FIG. 3 is flattened as shown at position 4 in FIG. 2 to fasten the lever (when in its initial position shown in FIG. 1). The lip L shows its upper face in its operating position and the hammer 2 is passed under the cover at the pseudo-rivet 8 into a practically horizontal position when the pouring spout 1 is rotated into its operating position. The excess metal 11 is spread out sufficiently to allow the inverting motion of the pouring spout 1 to take place by 180° radial rotation from the cover, around a horizontal sliding axis in a direction from the riveted lug 3 toward the hammer 2, between the time of staving in the protective cap 6 and that of clipping of the ring 12.

FIGS. 1 and 2 together show that integration of the pouring spout 1 with its reinforced lip edge 9 and open clipping ring 12, coupled by its clipping flange 13 with hammer 2, is strengthened because the lip edge 9 and the clipping ring 12 laterally and symmetrically enclose the side edges of the hammer 2 to form with it a one-piece assembly.

In case the pouring spout 1 of the invention to be riveted flat on the plane of the cover, it would be theoretically advisable for the plane of the hammer 2 in FIG. 2 and the plane of the outer edge 9 of the pouring spout 1 to be the same plane. In that case, the volume of the pouring spout inverted on mounting and riveted flat on the cover would be partially outside the cover, without thereby impairing vertical stacking of the cans, since stacking uses the space between the outer peripheral raised rim 14 of cover A shown in FIG. 3 and the point of the flange 13 most distant from the hammer.

FIG. 3 shows in top perspective cover A (crimped on container B) with, as already mentioned, the raised rim 14, the protective cap 6, its precut perimeter 7 and the body of the hollow pseudo-rivet 8.

The top of the cover is provided with a recessed portion 15 of cover A, the so-called staving zone, intended to receive the inverted pouring spout 1 flush along the inverted upper plane of its outer edge 9. It can be seen on FIG. 3 that, if the recessed portion 15 is shifted below the base plane of the hammer 2, the hammer necessarily then contacts the surface of the protective cap 6 and theoretically in the same plane as that of the open ring 12. The lever of the invention is configured with angulation between its drive arm and its resistant arm, which was not previously the case when the pouring spout was placed flush on the flat cover (without staving in the protecting cap), and in that case the hammer was then in the plane of the outer edge 9 of the pouring spout.

The recessed portion 15 of the embodiment shown in FIGS. 3 and 4 makes it possible both to limit the height of passage of the pouring spout 1 after its riveting in inverted position on cover A attached to container body B and to angulate the lever between its drive arm (the pouring spout) and its resistant arm (the hammer), in order to minimize the stress due to staving in the protective cap 6, by reason of the great improvement of torque in relation to the straight lever.

FIG. 4 shows the inverted pouring spout 1, drive arm of the metal hand lever, the resistant arm of which is the hammer 2, riveted in the center of cover A. The inverted pouring spout 1 bears on the recessed portion 15 and the base of the hammer 2 contacts the protective cap 6 still in place.

The highest point 17 of the inverted pouring spout 1 is at the top of the open clipping ring 12. That point should optimally be at a height h from the plane of the recessed portion 15 of the cover, i.e. the staving zone, so that, on the one hand, the pouring spout 1 has a sufficient useful height after clipping to allow real ease of use of the pouring spout 1 and, on the other, that height h optimally brings the highest point 17 approximately into the plane of the raised rim 14 of cover A, so that the pouring spout 1 does not go beyond the plane of the raised rim 14, which would be detrimental to the customary packing or stacking of the cans or containers in cardboard packs. It is also clear that the useful level of the recessed portion 15 of the cover A in relation to the plane of cover A must satisfy a requirement of technical feasibility with respect to the thickness and mechanical characteristics of the metal sheets used for fabrication of the cover.

FIG. 5 clearly shows, in a vertical intermediate position of the pouring spout 1, after staving in of the protective cap 6, how the tolerance strip 11 makes possible the radial rotation on a sliding axis in relation to cover A of the lever assembly through its entire possible angular sector of 180° until clipping of the spout 1 in the hole of the protective cap 6.

To facilitate the spread of the tolerance strip directionally, on radial rotation of the lever on a sliding axis at the time of staving in of the protective cap, it is desirable for the tolerance strip to be arranged between two creases perpendicular to the tolerance strip, that is, parallel to each other and to the passive side of the hammer, The passive side, to which the riveting tongue leads, being able in turn to take the place of one of the creases, the other having to be situated slightly ahead of the riveting hole of the tongue coming from the hammer.

Figure 6:
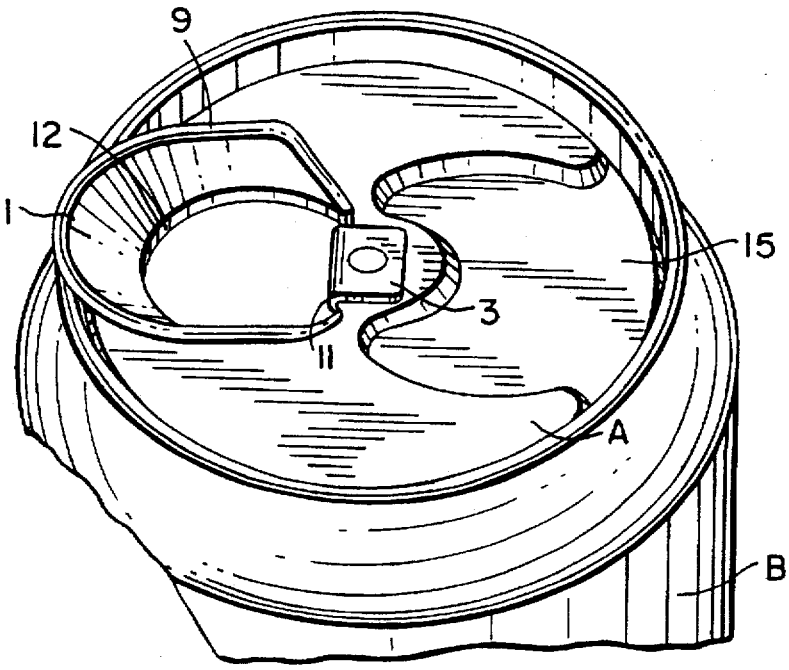

FIG. 6 shows the pouring spout 1 clipped in its operating position.

It goes without saying that for total ease of use, it is advisable for the pouring spout 1 to be in a totally stationary position and integral with cover A of container B. Just the clipping of the pouring spout in the hole of the protective cap 6 by the flange 13 of the ring 12 might seem sufficient. However, on use, it would be realized that the elasticity of the metal of cover A would have the effect of leaving the pouring spout 1 slightly floating after clipping.

So that the pouring spout 1 has a real stable position during use, it is necessary for the bottom of the lip L to bear with slight pressure on the raised rim 14 of the cover once clipping of the spout 1 in the hole of the protective cap 6 is completed.

It is therefore a question of using the elastic properties of the metal of cover A and secondarily of prestressing the metal of lip L for the pouring spout 1 after clipping between the outer face of the cover and its edge.

In fact, after clipping, the clipping flange 13 in the upper region of its section, that is, the region opposite its bevel region, bears flat on the cover at the inner edge of the hole freed of the protective cap, because of the combined opposing stresses applied, on the one hand, by the elastic plane face of cover A on the flange 13 and, on the other, by the raised rim 14 of the cover freely abutting the lower face of the lip L of the pouring spout 1. Furthermore these opposing stresses along the perimeter 7 of the hole of the protective cap 6 result in a tight metal/metal seal sufficient during pouring to avoid a discharge of liquid between the pouring spout 1 and the prestressed cover A. The prestressing has the positive result, finally, that the bearing of pouring spout 1 on the raised rim 14 of the cover renders completely impossible any pinching of the lower lip of the mouth just between the pouring spout 1 and the raised rim 14 of the cover.

It is to be noted that the pouring spout 1 is in a configuration of projecting slightly beyond the raised rim of the cover, always for the sake of the user's greatest convenience.

Figure 7:
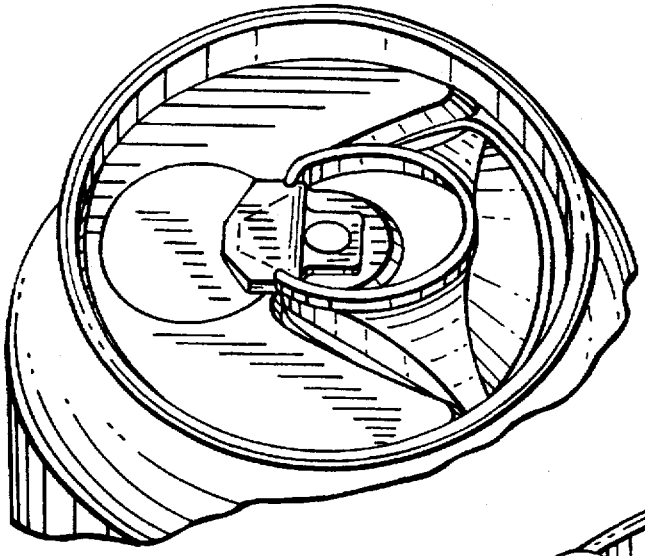
FIGS. 7 and 8 are perspective views showing another embodiment of the pouring spout and can cover in operation.
Figure 8:
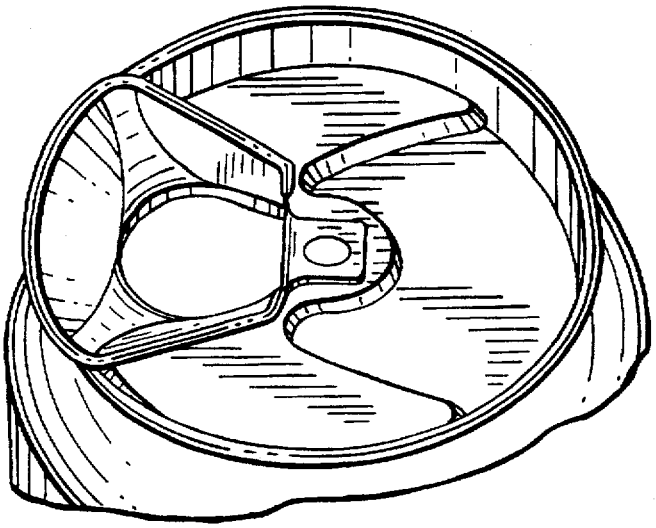

FIGS. 7 and 8 present a variant of the pouring spout corresponding roughly to the greatest possible useful working size. FIGS. 9 and 10 represent another variant, in which the shape of the pouring spout is designed for the pouring spout to bear flat on the cover in the vicinity of the channel.

In operation the pouring spout of the invention is operated as follows: when the protective cap 6 is not yet staved in, one quite simply has to pass a finger, preferably the index finger, into the hole of the open ring 12, so that the last phalanx of the finger can bear on the lip L of the inverted pouring spout, in order to apply there the slight force necessary for the action of the hammer 1 on the protective cap 6.

It is necessary to note here the convenience of using a phalanx and not the tip of the finger and its nail, as in the present cans and as in the THOMASSEN patent, in order to operate the lever and its protective cap staving nose.

Women, in particular, who want to protect their nails, dread using these prior art tabs.

The pouring spouts of the invention just must be sturdy and can be fabricated by any known method, including the use of molded plastic on the riveted tongue 3, and, in particular, the methods of fabrication of all metal container tabs, in combinations of materials capable of resulting in the best possible recycling conditions.

Covers equipped with the pouring spouts of the invention are stackable in a single position and in a slightly smaller number in the same space as the standard lever covers.

Center riveting of the tab on the present covers was chosen for beverage container covers because of the smaller size of those covers. Pouring spouts according to the invention can be mounted on larger diameter covers. In this case, riveting would no longer be in the center of the cover.

Pouring spouts according to the invention can also be fabricated with riveting in the center of the cover, so that the staving in, where the inverted pouring spout is recessed, remains outside the circular channel situated at the base of the raised rim, in order for that channel to retain its important role in the "seaming" of the cover provided with the pouring spout on the body of the can.

For that purpose, by increasing the length of the riveting tongue between its riveting hole and the passive side of the hammer to which it leads by a calculable value, which comes down to the same thing as increasing the quantity of excess metal 11, after radial rotation of the pouring spout on a sliding axis, following staving in of the cover, one can obtain a clipped positioning of the pouring spout extending beyond the raised rim 14 of the cover. For that purpose, it is also necessary for the capped hole to be brought as close as possible to the channel and for the pseudo-rectilinear portion of its perimeter to be as distant as possible from the riveting point.

Let us note here that a rectilinear segment of the perimeter of the protective cap under the hammer perpendicular to a diameter of the cover facilitates placement of the pouring spout.

It is be noted, finally, that the invention, at the beginning of the recessed portion or staving zone 15 of the cover, offers the only possible geometry of integration of a pouring spout with a staving lever, without that pouring spout passing the upper plane of the container and permitting the vertical stacking of containers.

While the invention has been illustrated and embodied in a volume pouring spout for a metal cover of a metal container and metal cover including same, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is desired to be protected by Letters Patent is set forth in the appended claims.

I claim:

1. An opening and pouring device for a container for a liquid, said container having cover (A) provided with an openable protective cap (6) defined by a precut perimeter (7) in said cover (A), wherein said opening and pouring device comprises a metal hand lever riveted to the cover (A) acting as means for opening said cover by staving in said protective cap (6) and wherein said metal hand lever includes:

a volume pouring spout (1) acting as a drive arm thereof for staving in said protective cap (6) provided with a lip (L) and an open clipping ring (12) having a clipping flange (13) of semicircular cross-section consisting of an outer lateral thickened portion, a riveting tongue (3) connected to the volume pouring spout (1) provided with a riveting hole (5) for facilitating the riveting of the metal hand lever to the cover (A), a hammer (2) integrated in the hand lever, acting as resistant arm of the metal hand lever and provided with a reinforced nose (10) for staving in the protective cap (6) along said precut perimeter (7) during an initial period of radial rotation of the metal hand lever, and means for facilitating radial rotation of said hand lever comprising a strip (11) of spreadable excess metal provided as an integral part of the riveting tongue (3) and situated between the riveting hole (5) of said riveting tongue (3) and a side of the hammer (2) opposite the staving nose (10);

so that after staving in the protecting cap (6) by rotation of said hand lever about a sliding rotation axis over a 180° maximum angular rotation of the hand lever, the pouring spout (1) is placed in an operating position by clipping with a pressure said open clipping ring (12) exactly in an opening in the cover (A) provided by staving in the protective cap (6) and passing the hammer (2) under an inner face of the cover (A) after spreading of the strip (11) of excess metal.

2. The opening and pouring device as defined in claim 1, wherein in the operating position of the pouring spout (1) an end of the lip (L) projects beyond an outer perimeter of the cover (A) and a lower part (16) of the lip (L) bears stably on an outer peripheral raised rim (14) provided on the cover (A).

3. The opening and pouring device as defined in claim 2, wherein the clipping flange (13) has a bevelled region to facilitate clipping and an upper region next to the bevelled region bearing flat on the cover over an entire circumference of the clipping flange (13) on an inner edge of the cover (A) after the clipping of the pouring spout (1) in the operating position because of conbined opposing stresses applied due to elasticity of the cover (A) bearing on the clipping flange (13) and due to pressure of the outer peripheral raised rim (14) on a lower face of the lip (L) of the pouring spout (1), so as to obtain a tight metal-metal seal along an inner perimetric zone of the opening formed by staving in the protective cap (6) to avoid a discharge of liquid between the pouring spout (1) and the cover (A).

4. The opening and pouring device as defined in claim 1, wherein prior to rotating the pouring spout (1) over the 180° into the operating position a highest point (17) of the pouring spout (1) is approximately in a plane of the outer peripheral raised rim (14) of cover (A) to facilitate stacking and packaging and the cover (A) has a recessed portion (15) to accommodate the pouring spout (1) to provide a height (h) between the highest point (17) and cover (A) so that the highest point (17) can approximately be in said plane.

5. The opening and pouring device as defined in claim 1, wherein the open clipping ring (12) of the pouring spout (1) is formed so that the hand lever can be operated by passing a finger through the open clipping ring (12) and a last phalanx of the finger can bear on the lip (L) to apply a pressure for action of the hammer (2), that pressure being minimized by angulation of the drive arm and resistance arm of the hand lever prior to rotating the hand lever.

6. The opening and pouring device as defined in claim 1, wherein the metal hand lever is in one-piece and the pouring spout (1) includes an outer peripheral portion (9) in addition to the open clipping ring (12) on a side opposite to the open clipping ring (12) to provide the hand lever with rigidity by enclosing side edges of the hammer (2) laterally and symmetrically and by fastening the outer peripheral portion (9) to the hammer (2) at said sides edges on both sides, so as to provide a mechanical bending strength without any other reinforcing ribbing or seaming arrangement.

7. The opening and pouring device as defined in claim 1, wherein space is provided between said open clipping ring (12) and the outer peripheral raised rim (14) of the cover (A) to allow vertical stacking of containers having the covers (A) with the opening and pouring device when the pouring spout (1) is located in an inverted position prior to rotating the pouring spout (1) into the operating position.

8. A cover and cover opening and pouring device for a container of a liquid, wherein said cover (A) is made of metal and is provided with an openable protective cap (6) defined by a precut perimeter (7) in said metal and a central rivet (8), and wherein said opening and pouring device comprises a metal hand lever riveted to the cover (A) acting as means for opening said cover by staving in said protective cap (6) and wherein said metal hand lever includes a volume pouring spout (1) acting as a drive arm thereof for staving in said protective cap (6) thus opening the container and comprising a lip (L) and an open clipping ring (12) provided with a clipping flange (13) of semicircular cross-section consisting of an outer lateral thickened portion of the open clipping ring (12), a riveting tongue (3) connected to the volume pouring spout (1) provided with a riveting hole (5) through which said rivet (8) is inserted and riveted to attach the hand lever to the cover (A), a hammer (2) integrated in the hand lever, acting as resistant arm of the metal hand lever and provided with a reinforced nose (10) for staving in the protective cap (6) along said precut perimeter (7) during an initial period of radial rotation of the metal hand lever and means for facilitating radial rotation of said hand lever comprising a strip (11) of spreadable excess metal provided as an integral part of the riveting tongue (3) and situated between the riveting hole (5) of said riveting tongue (3) and a side of the hammer (2) opposite the staving nose (10), so that after staving in the protecting cap (6) by rotation of said hand lever about a sliding rotation axis and 180° maximum angular rotation of the hand lever about the sliding rotation axis, the pouring spout (1) is placed in an operating position by clipping by a pressure said open clipping ring (12) exactly in an opening in the cover (A) provided by staving in the protective cap (6) and the hammer (2) then passes under an inner face of the cover (A) after spreading of the strip (11) of excess metal.

9. A container for a liquid comprising a cylindrical metal container body (B) and a metal cover (A) on the container body and provided with an opening and pouring device, wherein the metal cover (A) includes means for stacking comprising a raised rim (14) around the outer periphrey thereof, is provided with an openable protective cap (6) defined by a precut perimeter (7) in said metal cover and includes a central rivet (8); and wherein said opening and pouring device comprises a metal hand lever riveted to the cover (A) acting as means for opening said cover by staving in said protective cap (6) and wherein the metal hand lever includes:

a volume pouring spout (1) acting as a drive arm thereof for staving in the protective cap (6), a lip (L) to facilitate pouring and an open clipping ring (12) provided with a clipping flange (13) of semicircular cross-section consisting of an outer lateral thickened portion of the clipping ring to facilitate securing the pouring spout (1) in an opening formed in the cover (A) by staving in the protective cap (6), a riveting tongue (3) connected to the volume pouring spout (1) provided with a riveting hole (5) through which said rivet (8) is inserted to facilitate the riveting of the hand lever to the cover (A), a hammer (2) integrated in the hand lever, acting as resistant arm of the metal hand lever and provided with a reinforced nose (10) for staving in the protective cap (6) along the precut perimeter (7) during an initial period of radial rotation of the hand lever, and means for facilitating radial rotation of the hand lever comprising a strip (11) of spreadable excess metal provided as an integral part of the riveting tongue (3) and situated between the riveting hole (5) of the riveting tongue (3) and a side of the hammer (2) opposite the staving nose (10);

so that, after staving in the protecting cap (6) by rotation of said hand lever about a sliding rotation axis over a 180° maximum angular rotation of the hand lever about the sliding rotation axis, the pouring spout (1) is placed in an operating position with the lip (L) bearing on the raised rim (14) of the cover (A) by clipping with a pressure the open clipping ring (12) exactly in the opening formed in the cover (A) provided by staving in the protective cap (6) while by passing the hammer (2) under an inner face of the cover (A) after spreading of the strip (11) of excess metal.

10. The container as defined in claim 9, wherein prior to rotating the pouring spout (1) over the 180° into the operating position, a highest point (17) of the pouring spout (1) is approximately in a plane of the outer peripheral raised rim (14) of cover (A) to facilitate stacking and packaging and the cover (A) has a recessed portion (15) to accommodate the pouring spout (1) to provide a height (h) between the highest point (17) and cover (A) so that the highest point (17) can approximately be in said plane.

* * * * *